US012607089B2

(12) United States Patent
Vasques

(10) Patent No.: US 12,607,089 B2
(45) Date of Patent: Apr. 21, 2026

(54) ANNULAR BARRIER

(71) Applicant: Welltec Manufacturing Center Completions ApS, Esbjerg N (DK)

(72) Inventor: Ricardo Reves Vasques, Zug (CH)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 30 days.

(21) Appl. No.: 18/593,356

(22) Filed: Mar. 1, 2024

(65) Prior Publication Data

US 2024/0295157 A1 Sep. 5, 2024

(30) Foreign Application Priority Data

Mar. 3, 2023 (EP) ..... 23160016
Aug. 10, 2023 (EP) ..... 23190900

(51) Int. Cl.
*E21B 33/127* (2006.01)
*E21B 36/00* (2006.01)

(52) U.S. Cl.
CPC ..... *E21B 33/1277* (2013.01); *E21B 36/008* (2013.01)

(58) Field of Classification Search
CPC ..... E21B 33/1243; E21B 33/1277; E21B 36/008; E21B 33/12; E21B 33/10; E21B 33/02; E21B 33/00
See application file for complete search history.

(56) References Cited

U.S. PATENT DOCUMENTS 9,447,655 B2 9/2016 Zhao
2006/0037748 A1 2/2006 Wardlaw
2015/0101813 A1* 4/2015 Zhao ..... E21B 36/00 166/302
2016/0348463 A1* 12/2016 Vasques ..... E21B 33/1277

FOREIGN PATENT DOCUMENTS

CN 215698830 U 2/2022
EP 2565368 A1 * 3/2013 ..... E21B 23/06
EP 3303760 A1 4/2018
WO 2016049424 A1 3/2016

OTHER PUBLICATIONS

Extended European Search Report for EP23160016.4 dated Jun. 28, 2023, 7 pages.

* cited by examiner

*Primary Examiner* — Caroline N Butcher
(74) *Attorney, Agent, or Firm* — Nixon & Vanderhye P.C.

(57) ABSTRACT

An annular barrier has a tubular metal part and an expandable metal sleeve having ends connected with the tubular metal part. An annular space is between the expandable metal sleeve and the tubular metal part, an expansion opening is provided in the tubular metal part through which fluid may enter for expansion. The annular barrier further includes a eutectic material and/or a bentonite material which in a first condition is arranged on the outer face of the tubular metal part in a first axial position different from the second axial extension of the expandable metal sleeve, and in a second condition and a second axial position the eutectic material and/or a bentonite material abuts a face of the expandable metal sleeve, and in an intermediate condition the eutectic material and/or a bentonite material is positioned between the first axial position and the second axial position.

15 Claims, 10 Drawing Sheets

ANNULAR BARRIER

Figure 1:
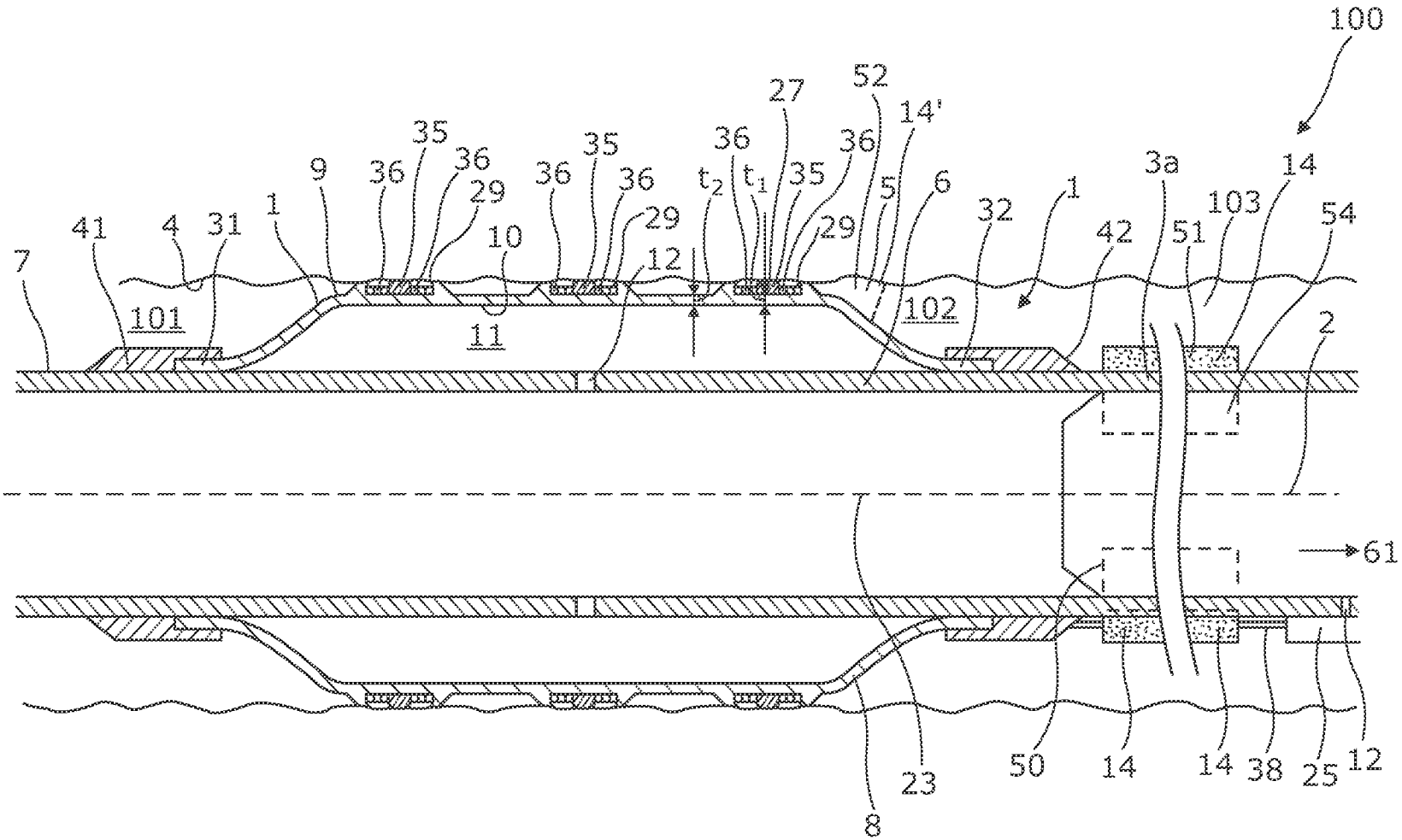

This application claims priority to EP 23190900.3 filed Aug. 10, 2023 and EP 23160016.4 filed Mar. 3, 2023, the entire contents of each of which are hereby incorporated by reference.

The present invention relates to an annular barrier for expansion in an annulus between a first well tubular metal structure and an inner face of a borehole or a second well tubular metal structure for providing zone isolation between a first zone and a second zone of the annulus. The invention also relates to a downhole system comprising the annular barrier and a downhole tool string.

In salt formations, the borehole of an oil or gas well may decrease over time, challenging the completion components, casings and liners arranged therein as these are dimensioned to the borehole as drilled. Annular barriers may be arranged along the casing or liner for providing zonal isolation, and annular barriers abutting the wall of the borehole are thus squeezed as the salt formation enlarges. Some annular barriers are made of a flexible material able to flex as the salt formation enlarges and still provide a proper seal; however, if the salt formation continues to enlarge, the annular barriers can no longer provide a proper seal, and thus the zonal isolation is broken.

It is an object of the present invention to wholly or partly overcome the above disadvantages and drawbacks of the prior art. More specifically, it is an object to provide an improved annular barrier which is suitable for implementation into salt formations.

The above objects, together with numerous other objects, advantages and features, which will become evident from the below description, are accomplished by a solution in accordance with the present invention by an annular barrier for expansion in an annulus between a first well tubular metal structure and an inner face of a borehole or a second well tubular metal structure for providing zone isolation between a first zone and a second zone of the annulus, the annular barrier having a first axial extension, where the annular barrier comprises:

- a tubular metal part for mounting as part of the first well tubular metal structure, the tubular metal part having an outer face,
- an expandable metal sleeve surrounding the tubular metal part and having an outer face facing towards the inner face of the borehole or the second well tubular metal structure and an inner face facing the outer face of the tubular metal part, a second axial extension along the first axial extension, and each end of the expandable metal sleeve being connected with the tubular metal part,
- an annular space between the expandable metal sleeve and the tubular metal part, and
- an expansion opening in the tubular metal part through which fluid may enter the annular space in order to expand the expandable metal sleeve, wherein the annular barrier further comprises a eutectic material and/or a bentonite material which in a first condition is arranged on the outer face of the tubular metal part in a first axial position different from the second axial extension of the expandable metal sleeve, and in a second condition and a second axial position the eutectic material and/or the bentonite material abuts a face of the expandable metal sleeve, and in an intermediate condition the eutectic material and/or the bentonite material is positioned between the first axial position and the second axial position.

By having eutectic material arranged on the outer face of the tubular metal part, the sealing ability of the annular barrier can easily be re-established by heating the eutectic material as then the eutectic material changes condition to a flowable condition and re-arranges itself between the expandable metal sleeve and the borehole, and as the eutectic material changes condition to a solid state, the volume of the eutectic material enlarges and provides a new proper seal. Thus, an annular barrier having such eutectic material is suitable for implementation into a salt formation as the annular barrier is still able to provide a proper seal over time when the salt formation has enlarged.

The annular barrier may comprise a bentonite material which in a first condition is arranged on the outer face of the tubular metal part in a first axial position different from and not overlapping the second axial extension of the expandable metal sleeve, and in a second condition and at a second axial position, the bentonite material abuts a face of the expandable metal sleeve.

In the intermediate condition of the bentonite material, the material is positioned between the first axial position and the second axial position.

In the first condition and first axial position, the bentonite material may be in powder form in a chamber. When in the intermediate condition, the bentonite material is released into the well fluid and undergoes a reaction with the well fluid and swells and solidifies into the second condition.

The bentonite material may be an absorbent swelling clay consisting mostly of montmorillonite (a type of smectite) which can either be Na-montmorillonite or Ca-montmorillonite. Na-montmorillonite has a considerably greater swelling capacity than Ca-montmorillonite.

Moreover, the annular barrier may comprise only the eutectic material in the first condition and the first axial position, and in the second condition and second axial position the eutectic material forms a solidified plug outside and abuts the outer face of the expandable metal sleeve.

In addition, the annular barrier may comprise only the bentonite material in the first condition and the first axial position, and in the second condition and second axial position the bentonite material forms a solidified plug outside and abuts the outer face of the expandable metal sleeve.

Further, the first axial position may not overlap the second axial extension of the expandable metal sleeve.

Also, the annular barrier may further comprise a fluid communication channel having a first opening in a first axial channel position, and the fluid communication channel extending towards a second opening in a second axial channel position, where the second axial channel position overlaps or abuts an axial position of the expandable metal sleeve, and the eutectic material is in the first condition arranged upstream to the first opening, and in the second condition the eutectic material and/or the bentonite material abuts the face of the expandable metal sleeve downstream to the second opening.

The axial position of the expandable metal sleeve may be the same as the second axial extension of the expandable metal sleeve.

Moreover, the first axial channel position may be closer to the first axial position than to the second axial position.

Further, the fluid communication channel may be a tube.

In addition, the tube may be a metal tube metallically connected with the tubular metal part.

Furthermore, one of the ends of the expandable metal sleeve may be connected with the tubular metal part by means of a connection part, and the fluid communication channel may extend through the connection part, providing fluid communication to the annular space.

Also, in the second condition the eutectic material and/or the bentonite material may overlap the second axial extension.

Moreover, the second opening may be arranged to overlap the second axial extension of the expandable metal sleeve.

Further, the fluid communication channel may be arranged to partly abut part of the outer face of the expandable metal sleeve.

In addition, the annular barrier may further comprise a chamber arranged on the outer face of the tubular metal part; in the first condition, the eutectic material and/or the bentonite material may be in powder form arranged in the chamber.

Furthermore, the eutectic material may be a solid block of eutectic material.

Also, the chamber may have a chamber opening in fluid communication with the first opening of the fluid communication channel.

In addition, the annular barrier may comprise both a eutectic material and a bentonite material, the bentonite material is arranged in a chamber and the eutectic material is arranged in a chamber, and both chambers are arranged on the outer face of the tubular metal part.

Furthermore, the bentonite material may in the first condition be in form of powder and arranged inside the chamber and then released into the annulus to react with well fluid and form an annular plug on top of and abutting the expandable metal.

Also, the eutectic material may be heated and then flowing into the annular space via the fluid communication channel in order to move to the second axial channel position.

By having bentonite material arranged on the outer face of the tubular metal part, the sealing ability of the annular barrier can easily be re-established just by letting the bentonite material into the well fluid. Furthermore, by having eutectic material the annular space can be filled with the eutectic material displacing the fluid inside the expandable space and forming a proper plug as the eutectic material solidifies. The bentonite material can then be used outside the annular barrier and the eutectic material inside the annular barrier. But in another embodiment, it may be vice versa. The flowable bentonite material and flowable eutectic material are thus able to enter smaller gaps than when the eutectic material is in its solid state, and upon solidification the eutectic material and the bentonite material increase in volume and fill up the gap even better. Thus, an annular barrier having such eutectic material and bentonite material is suitable for implementation into a salt formation as the annular barrier is then still able to provide a proper seal even after some time when the salt formation has enlarged.

Moreover, the eutectic material may comprise bismuth or an alloy of bismuth.

Further, the eutectic material may be a post-transition metal material such as bismuth or a bismuth alloy in one monolithic whole as a block or in powder form.

In addition, in the first condition the eutectic material and/or the bentonite material may have a first volume, and in the intermediate condition the eutectic material and/or the bentonite material may have a second volume being smaller than the first volume.

Furthermore, in the second condition the eutectic material and/or the bentonite material may be arranged at least partly on the outer face of the expandable metal sleeve.

Also, in the second condition the eutectic material and/or the bentonite material may be arranged at least partly in the annular space.

Moreover, the annular barrier may further comprise an equalising fluid channel providing fluid communication between the annular space and the annulus for allowing fluid within the annular space to flow out of the annular space when the eutectic material and/or the bentonite material is displacing the fluid.

Further, the equalising fluid channel may have a first aperture in fluid communication with the annular space and a second aperture in fluid communication with the second zone.

In addition, the first opening and the second opening may be arranged in the connection part.

Furthermore, the annular barrier may also comprise a valve unit for controlling fluid communication between the expansion opening and the annular space via a conduit.

Moreover, the conduit may be used as the fluid communication channel.

Also, the valve unit may be fluidly connected to the equalising fluid channel.

Moreover, the expandable metal sleeve may be provided with a sealing unit on the outer face of the expandable metal sleeve.

Further, the sealing unit may be arranged in a circumferential groove of the expandable metal sleeve.

In addition, the sealing unit may further comprise an annular sealing element and a retaining element.

Furthermore, the sealing unit may comprise an intermediate element.

Also, at least the retaining element may comprise a post-transition metal material such as bismuth or a bismuth alloy.

Moreover, the annular sealing element may be made of elastomer, natural or synthetic rubber, polymer or a similar material.

Further, in the first condition the first opening may abut the eutectic material.

In addition, the first opening may comprise a plug at least partly made of a eutectic compound or alloy.

Furthermore, in the first condition the eutectic material and/or the bentonite material may extend at least partly around a circumference of the tubular metal part.

Also, in the second condition the eutectic material and/or the bentonite material may extend fully around the circumference of the tubular metal part.

Moreover, the first well tubular metal structure may have a higher melting point than that of the eutectic material.

Further, the eutectic material and/or the bentonite material may have a first outer diameter when being in the first condition, and the first outer diameter may be smaller or equal to an outer diameter of the expandable metal sleeve in an unexpanded condition of the expandable metal sleeve.

In addition, in the intermediate condition the eutectic material and/or the bentonite material may be at least partly in a liquid state.

Furthermore, the first zone may be a production zone, and the eutectic material may be arranged in the second zone. When the eutectic material enters the annular space, displacing fluid in the annular space, the lower pressure in the first zone will assist the fluid out of the annular space through the equalising fluid channel due to the lower pressure in the production zone.

Also, the annular barrier may further comprise a heating unit for heating the eutectic material, and the heating unit may be arranged on the outer face of the tubular metal part adjacent to the eutectic material.

Moreover, the annular barrier may further comprise insulation arranged so as to enclose the heating unit and the eutectic material.

Further, the invention relates to a downhole system comprising the annular barrier and a downhole tool string comprising a heating unit for heating the eutectic material.

In addition, the downhole tool string may further comprise a fluid displacement section arranged adjacent to the heating unit.

Furthermore, the heating unit may comprise a chamber with thermite material, a liquid and a heater in form of a heating channel extending into the chamber with eutectic material.

The heating unit may comprise a pump arranged to assist circulation of the heated liquid inside the heating channel.

Furthermore, the bentonite material may be arranged in a chamber having a piston dividing the chamber in a first chamber part and a second chamber part, the bentonite material being arranged in the first chamber part having an opening with a shear disc and the second chamber part having pressure charge 48, such as thermite, gas cartridge or similar, the piston being maintained in a first piston position by a shear pin.

Finally, the invention relates to a downhole system comprising the annular barrier and a downhole tool string comprising a fluid displacement section arranged opposite the annular barrier inside the tubular metal part.

Figure 2A:
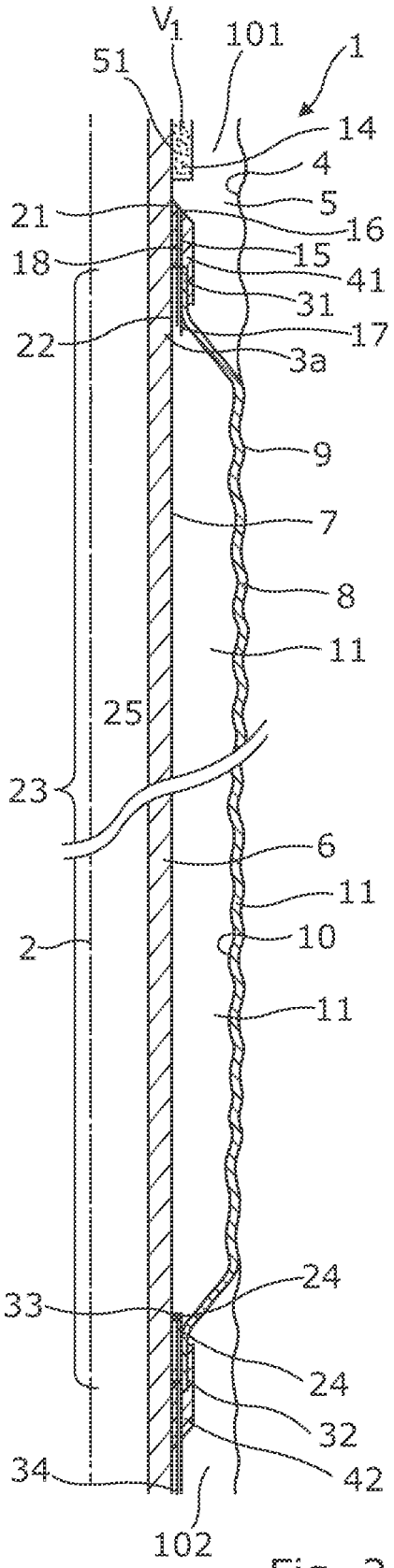
Figure 2B:
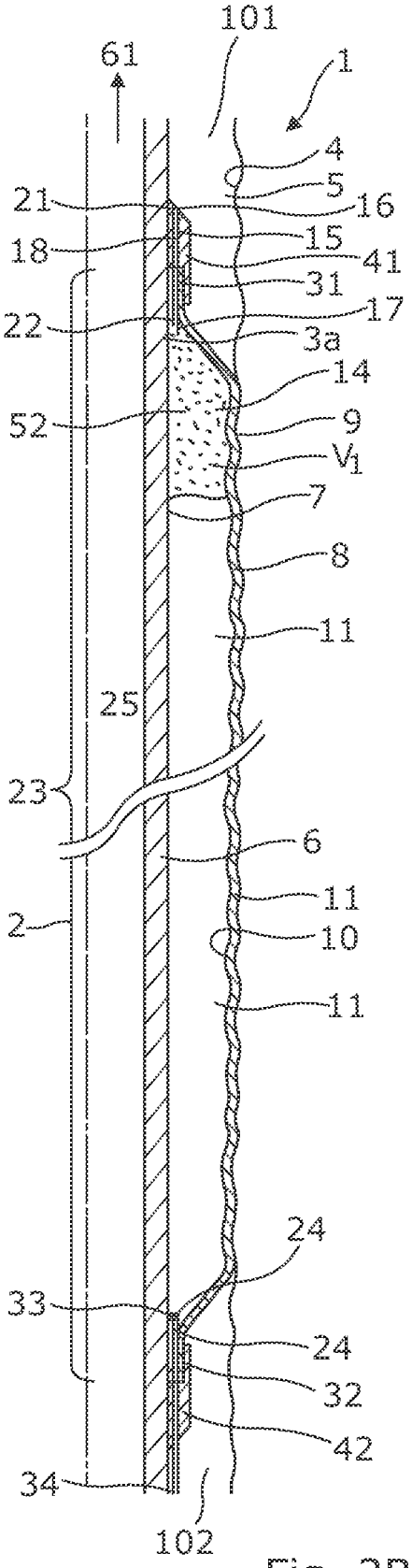
Figures 3, 4, 5:
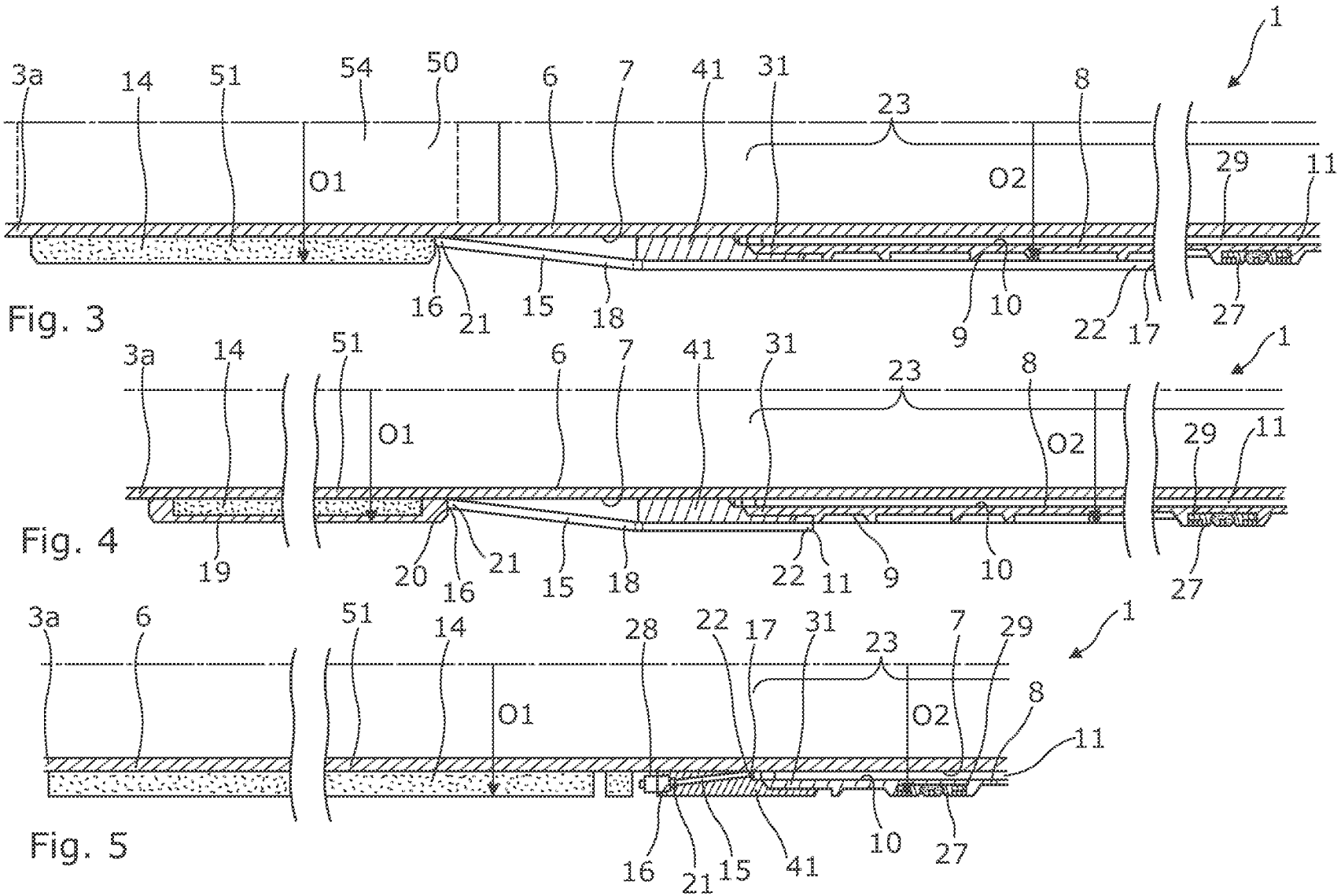
Figure 6:
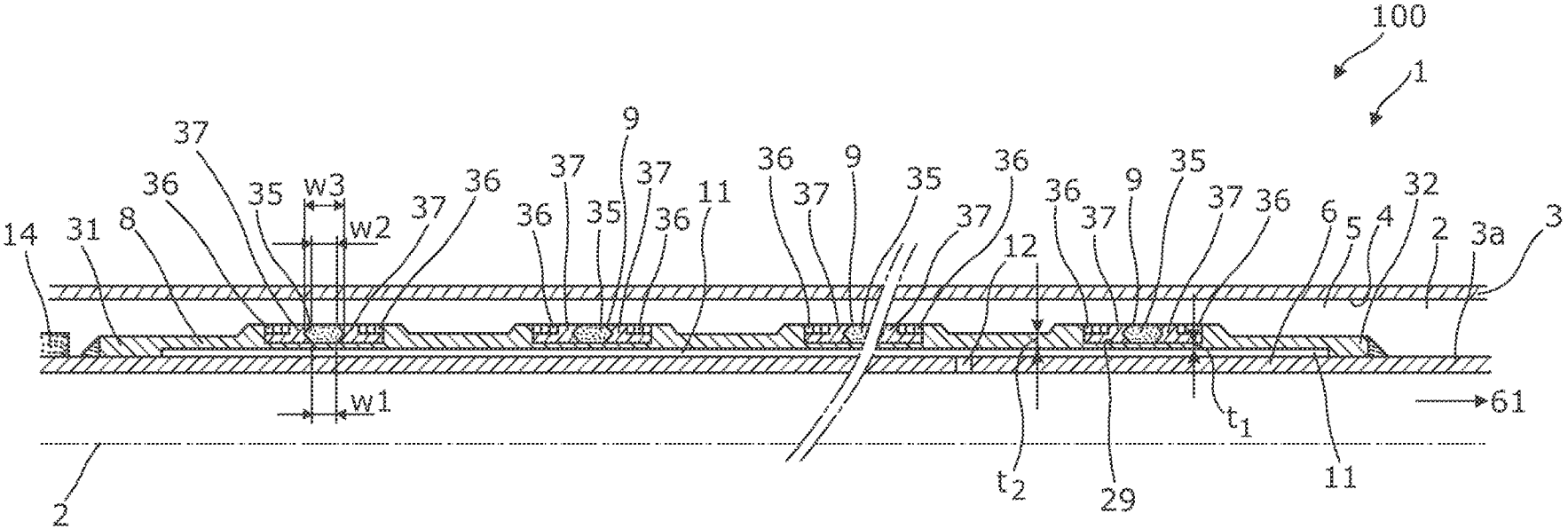
Figure 7A:
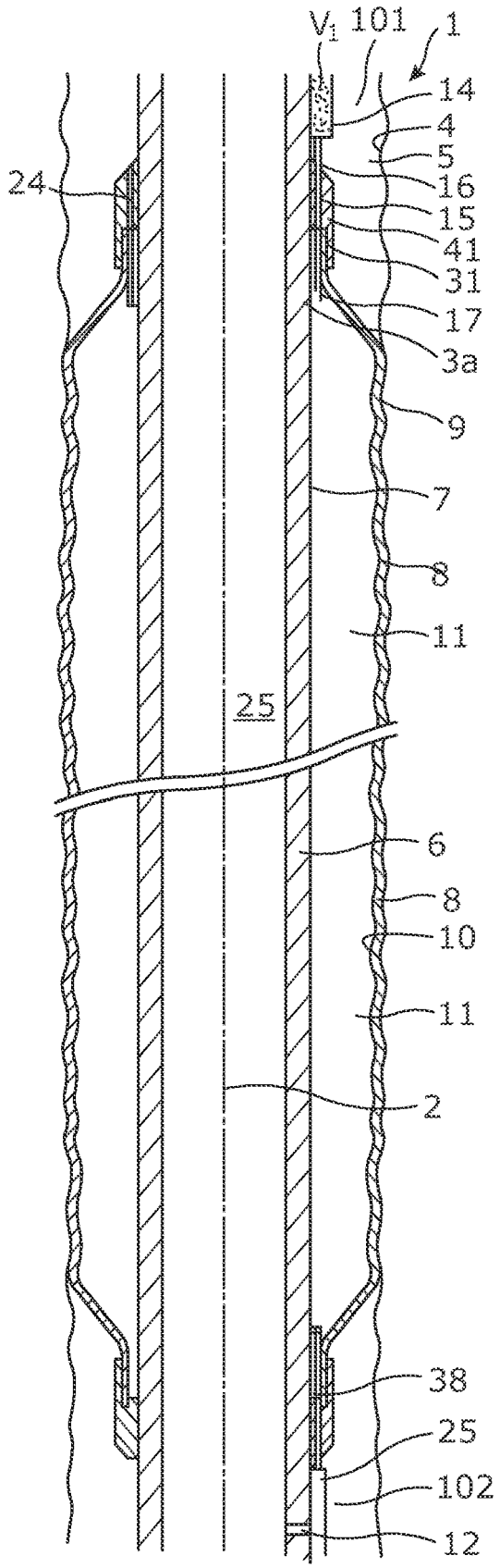
Figure 7B:
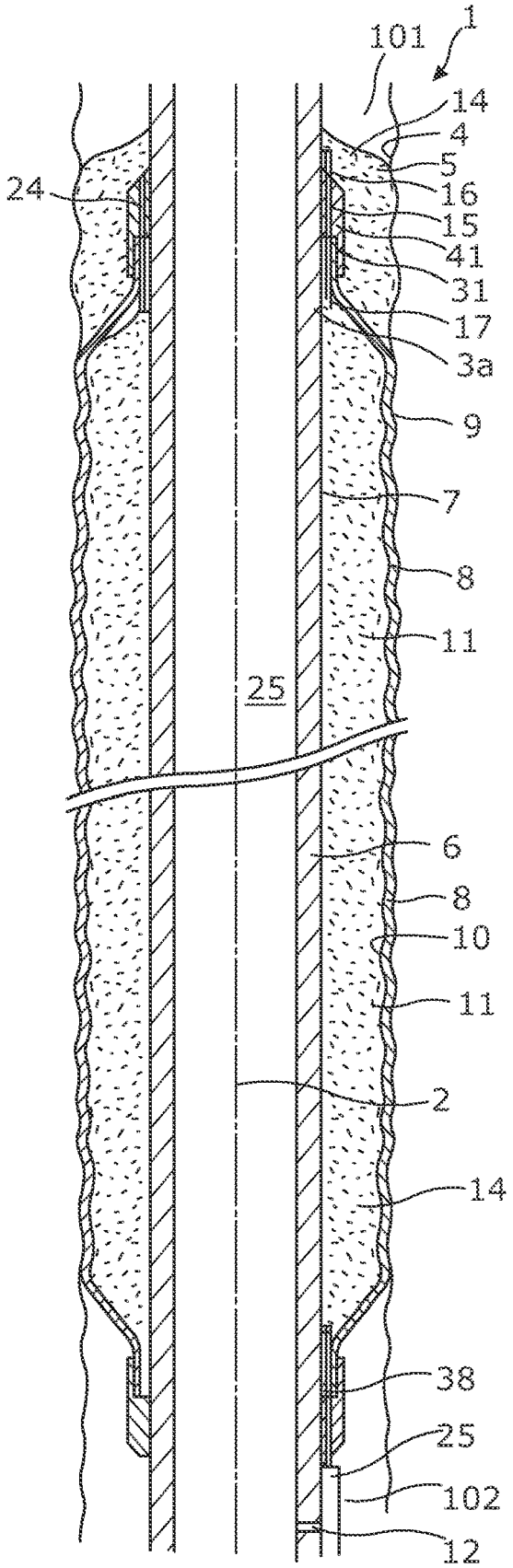
Figure 8:
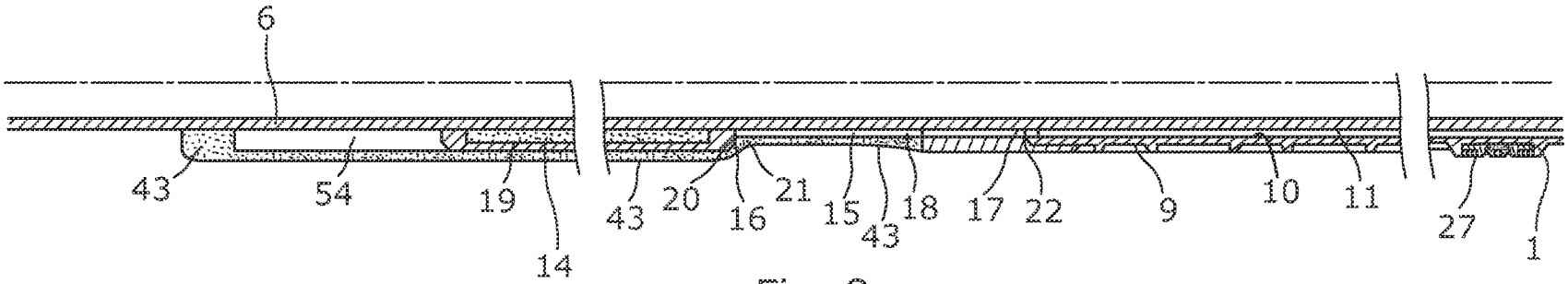
Figure 9:
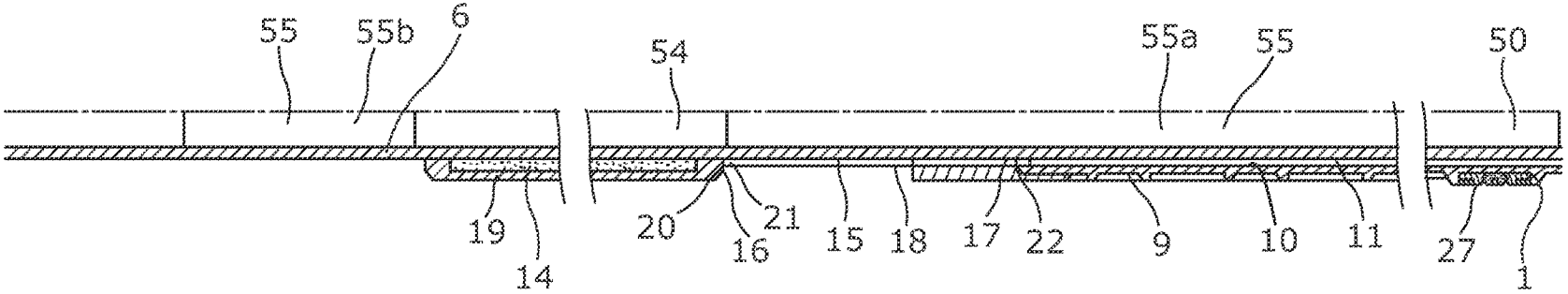
Figure 10:
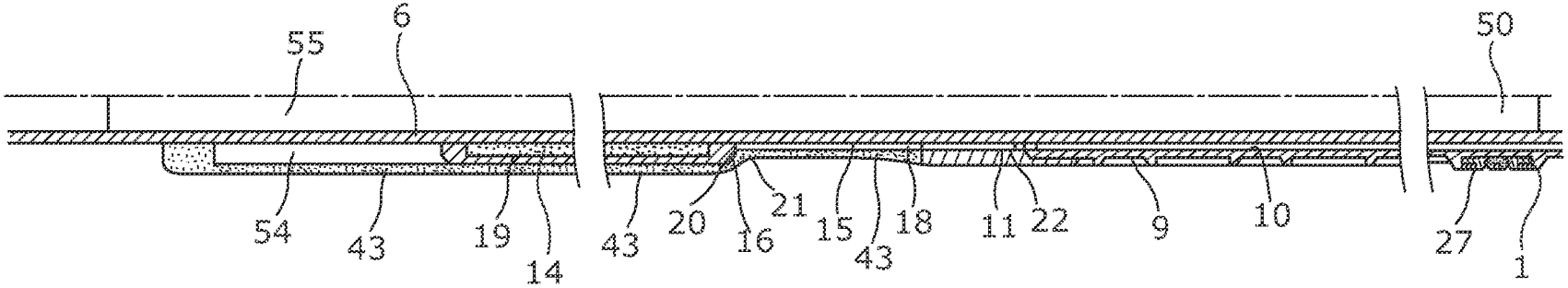
Figure 11A:
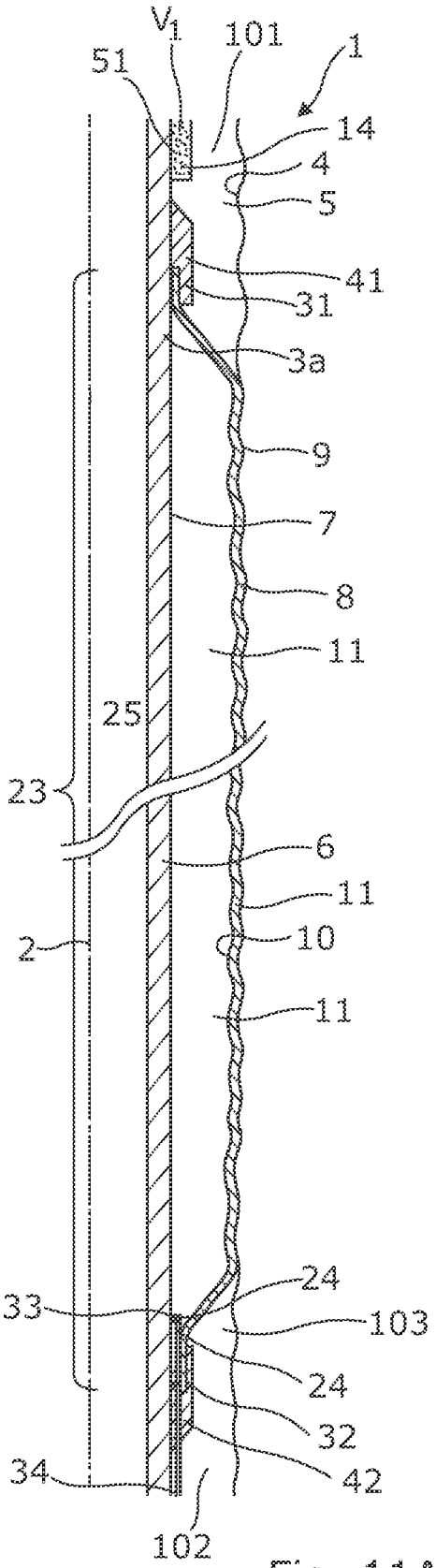
Figure 11B:
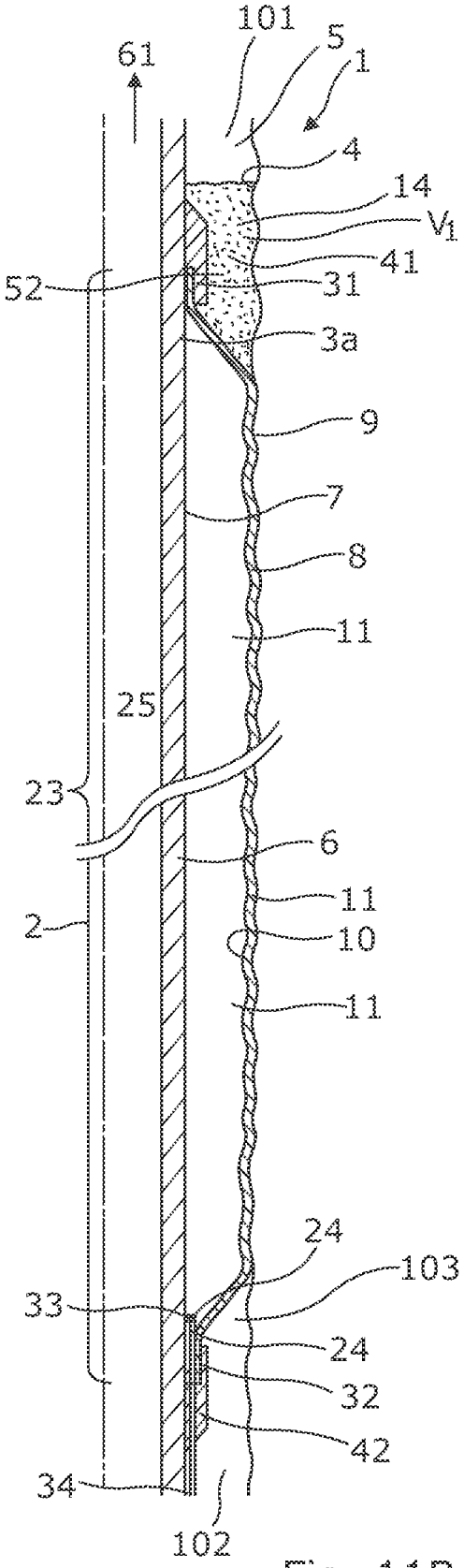
Figure 12A:
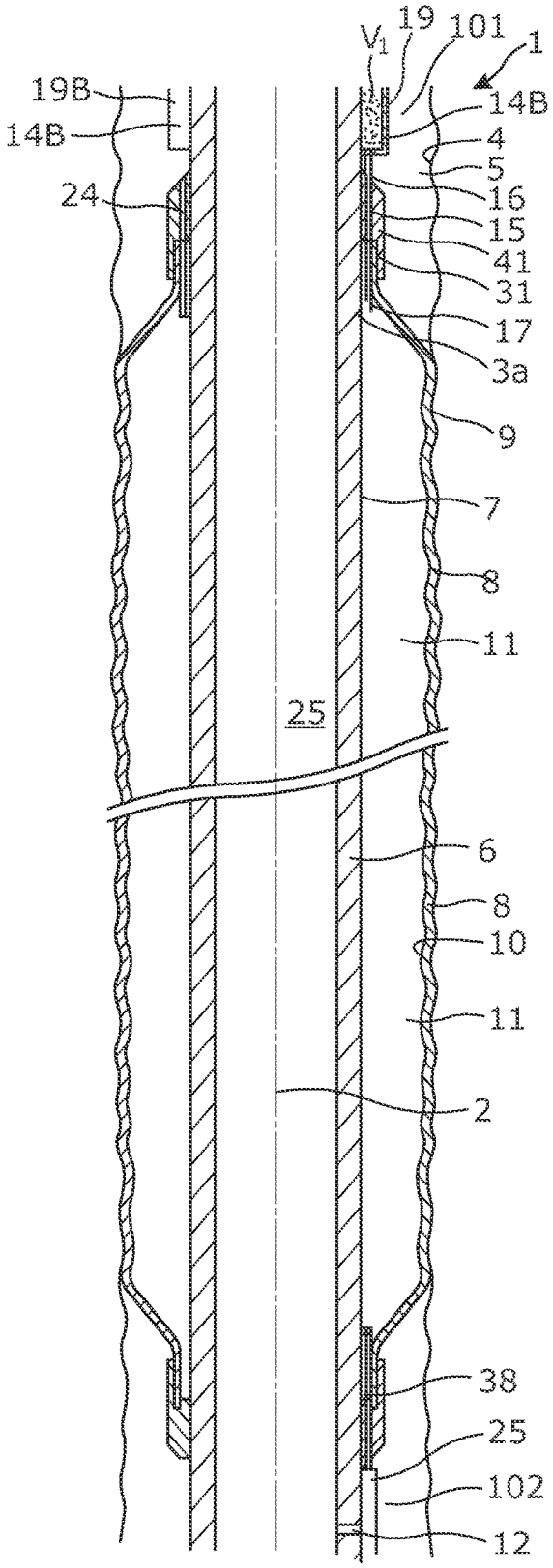
Figure 12B:
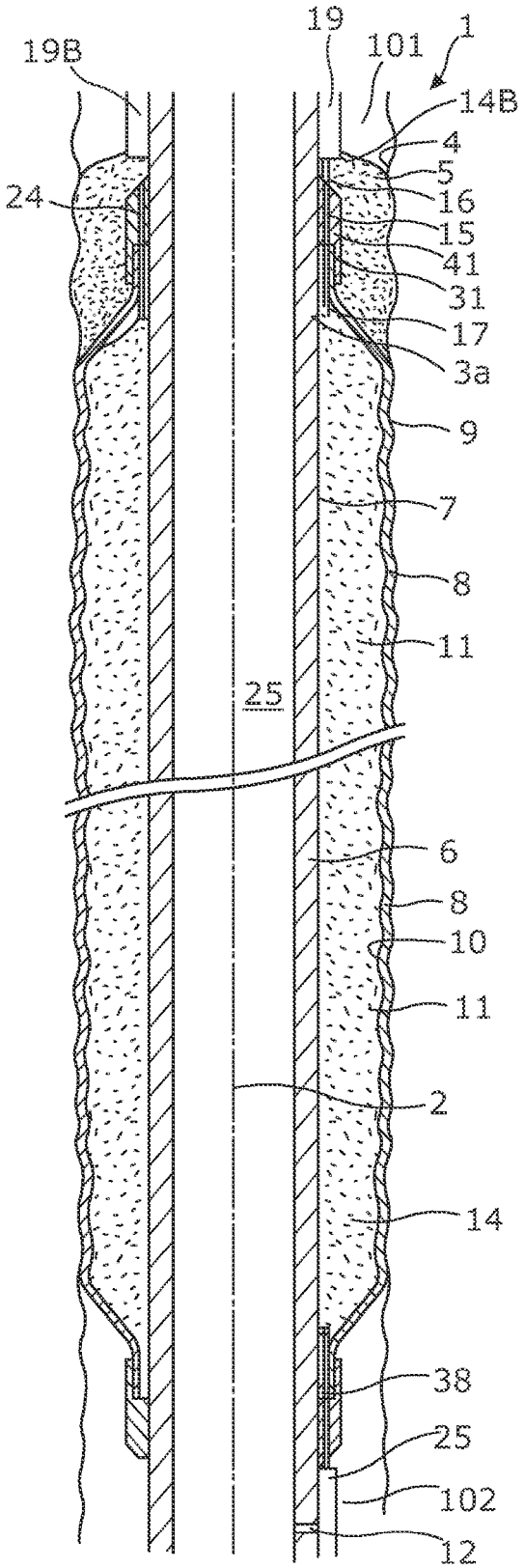
Figure 13:
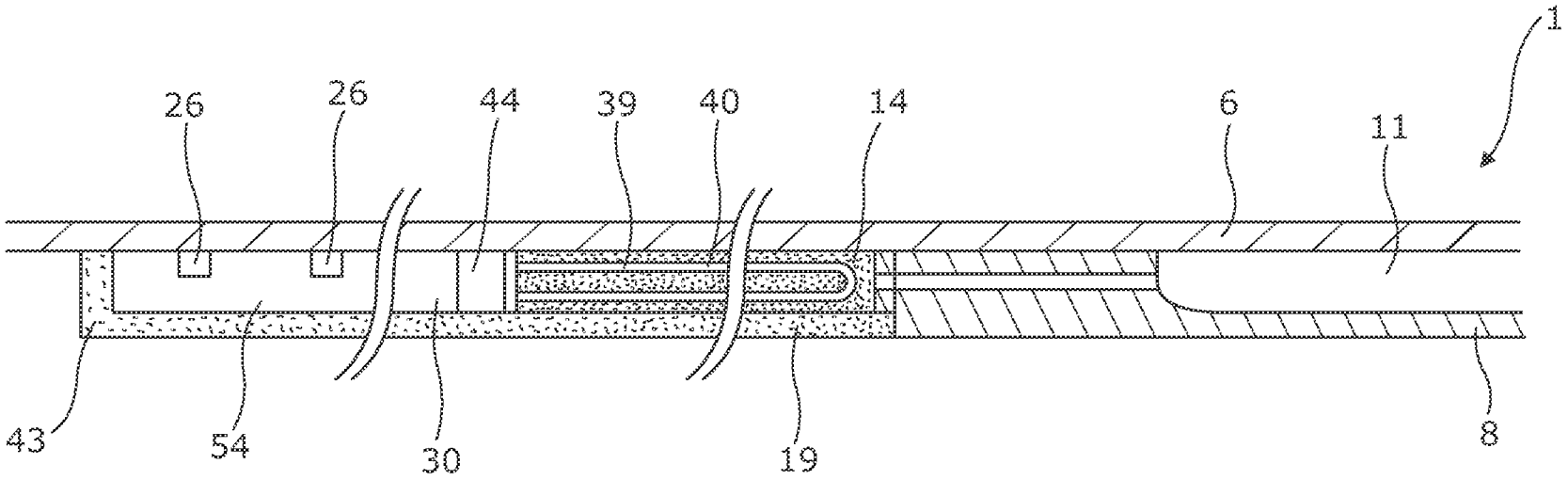
Figure 14A:
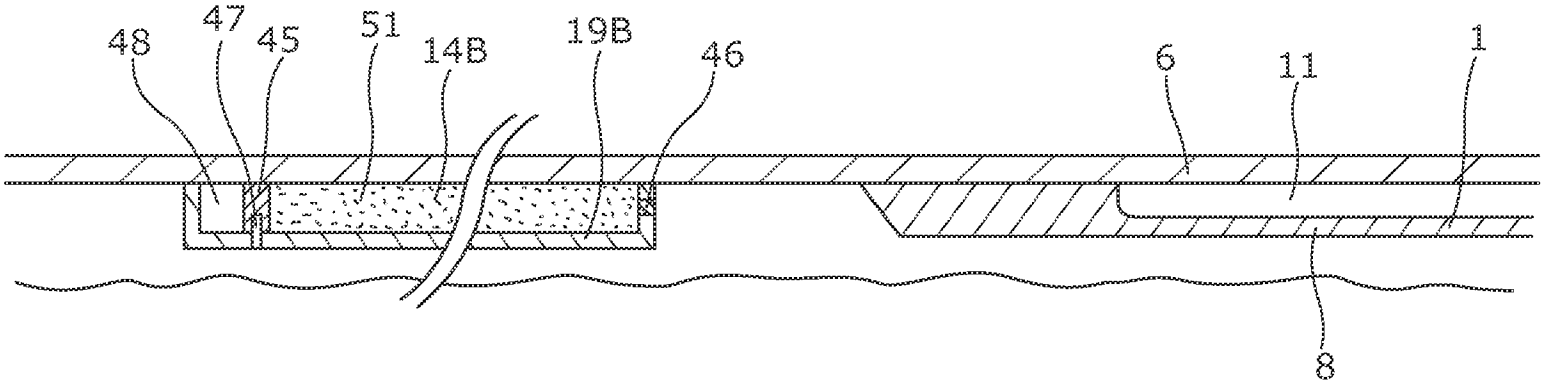
Figure 14B:
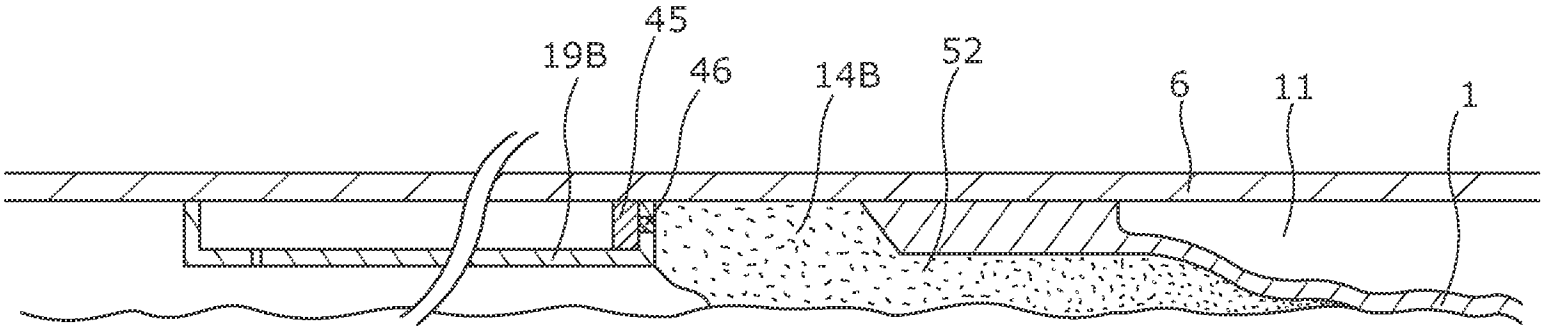

The invention and its many advantages will be described in more detail below with reference to the accompanying schematic drawings, which for the purpose of illustration show some non-limiting embodiments and in which:

FIG. 1 shows a cross-sectional view of an annular barrier having a block of eutectic material in a first condition, FIG. 2A shows a cross-sectional view of another annular barrier having a eutectic material in a first condition, FIG. 2B shows a cross-sectional view of the annular barrier of FIG. 2A having the eutectic material in a second condition, FIG. 3 shows a cross-sectional view of part of another annular barrier having a block of eutectic material in a first condition, FIG. 4 shows a cross-sectional view of part of yet another annular barrier having a chamber with powdered eutectic material in a first condition, FIG. 5 shows a cross-sectional view of part of yet another annular barrier having a block of eutectic material in a first condition, FIG. 6 shows a cross-sectional view of another annular barrier having a eutectic material in a first condition, FIG. 7*a* shows a cross-sectional view of another annular barrier having a eutectic material in a first condition, FIG. 7*b* shows a cross-sectional view of the annular barrier of FIG. 7*a* having the eutectic material in a second condition, FIG. 8 shows a cross-sectional view of yet another annular barrier having a eutectic material in a first condition, FIG. 9 shows a cross-sectional view of another annular barrier having a eutectic material in a first condition, FIG. 10 shows a cross-sectional view of yet another annular barrier having a eutectic material in a first condition, FIG. 11A shows a cross-sectional view of another annular barrier having a eutectic material in a first condition at the first axial position, FIG. 11B shows a cross-sectional view of the annular barrier of FIG. 11A having the eutectic material in a second condition at the second axial position outside and abutting the annular barrier, FIG. 12*a* shows a cross-sectional view of yet another annular barrier having a eutectic material and a bentonite material in a first condition, FIG. 12*b* shows a cross-sectional view of the annular barrier of FIG. 12*a* having the eutectic material and the bentonite material in a second condition, where the eutectic material is arranged inside the expandable metal sleeve and the bentonite material is arranged outside and abuts the expandable metal sleeve, FIG. 13 shows a cross-sectional view of part of yet another annular barrier having a heating unit having a heating channel inside the chamber with the eutectic material, FIG. 14*a* shows a cross-sectional view of part of yet another annular barrier having a chamber with a bentonite material in a first condition, and FIG. 14*b* shows a cross-sectional view of part of the annular barrier of FIG. 14*a* having the bentonite material in a second condition, where the bentonite material is arranged outside and abuts the expandable metal sleeve.

All the figures are highly schematic and not necessarily to scale, and they show only those parts which are necessary in order to elucidate the invention, other parts being omitted or merely suggested.

FIG. 1 shows an annular barrier 1 in its expanded state in an annulus 103 between a first well tubular metal structure 3*a* and an inner face 4 of a borehole 5 for providing zone isolation between a first zone 101 and a second zone 102 of the annulus. The annular barrier 1 has a first axial extension 2 along which it extends along the longitudinal extension of the well tubular metal structure 3*a* and the borehole 5. The annular barrier 1 comprises a tubular metal part 6 for mounting as part of the first well tubular metal structure 3*a*. The tubular metal part 6 has an outer face 7 facing the inner face 4 of the borehole 5. The annular barrier 1 further comprises an expandable metal sleeve 8 surrounding the tubular metal part 6 and having an outer face 9 facing towards the inner face 4 of the borehole 5 and an inner face 10 facing the outer face 7 of the tubular metal part. The expandable metal sleeve 8 has a second axial extension 23 along the first axial extension representing the length of the expandable metal sleeve. Each end 31, 32 of the expandable metal sleeve 8 is connected with the tubular metal part 6 for enclosing an annular space 11 between the expandable metal sleeve and the tubular metal part. An expansion opening 12 is arranged in the tubular metal part 6 through which fluid may enter the annular space 11 in order to expand the expandable metal sleeve 8. The annular barrier further comprises a eutectic material 14 which in a first condition is arranged on the outer face 7 of the tubular metal part 6 in a first axial position 51 different from the axial position of the expandable metal sleeve, i.e. the first axial position 51 is different from the second axial extension 23, of the expandable metal sleeve 8 along the first axial extension 2, so that the eutectic material 14 is arranged outside the annular space 11 and the expandable metal sleeve.

By having eutectic material 14 arranged on the outer face 7 of the tubular metal part 6, the sealing ability of the annular barrier 1 can easily be re-established by heating the eutectic material as then the eutectic material changes condition to a flowable condition and re-arranges itself between the expandable metal sleeve 8 and the borehole 5, and as the eutectic material changes condition to a solid state, the volume of the eutectic material enlarges and provides a new proper seal. The flowable or even liquified eutectic material 14 is thus able to enter smaller gaps than when the eutectic material is in its solid state, and upon solidification the eutectic material increases in volume and fills up the gap even better. Thus, an annular barrier having such eutectic material is suitable for implementation into a salt formation as the annular barrier is then still able to provide a proper seal even after some time when the salt formation has enlarged.

Instead of having the eutectic material, the annular barrier may have a bentonite material 14B. The bentonite material 14B is in the first condition in the form of a powder and in the second condition the bentonite material 14B is an absorbent swelling clay consisting mostly of montmorillonite (a type of smectite) which can either be Na-montmorillonite or Ca-montmorillonite. Na-montmorillonite has a considerably greater swelling capacity than Ca-montmorillonite. The bentonite material 14B is in powder form and is arranged in a chamber 19B, then in the intermediate position the power reacts with liquid which may be the well fluid and in the second condition the bentonite material has absorbed the liquid and has formed as a firm clay substance abutting the face of the expandable metal sleeve of the annular barrier 1.

When entering a downhole tool string 50 comprising a heating unit 54 for heating the eutectic material 14 from within the first well tubular metal structure 3*a* or tubular metal part 6, the eutectic material 14 becomes flowable and flows down in relation to a top 61 of the well and towards the expanded expandable metal sleeve 8 for resting on top of a sealing unit 27 along the circumference of the annular barrier 1 as indicated by the dotted line and reference 14' as representing the eutectic material in the second condition. This may occur many years after having set the annular barrier 1 in order to plug and abandon the well, or if the sealing of the annular barrier has become less efficient due to formation changes, such as salt formation.

In FIG. 2A, the eutectic material 14 is in the first condition on the outer face 7 of the tubular metal part 6 in the first axial position 51, which is different from the second axial extension 23 of the expandable metal sleeve 8 along the first axial extension 2. After being heated, the eutectic material 14 becomes flowable and flows to a second axial position 52 and a second condition where the eutectic material abuts the face 9, 10 of the expandable metal sleeve 8, as shown in FIG. 2B. When being in the flowable condition, the eutectic material 14 is in an intermediate condition where the eutectic material is positioned between the first axial position 51 and the second axial position 52.

In FIGS. 2A and 2B, the annular barrier 1 further comprises a fluid communication channel 15 having a first opening 16 in a first axial channel position 21, and the fluid communication channel extends towards a second opening 17 in a second axial channel position 22. In FIGS. 2A and 2B, the second axial channel position 22 overlaps an axial position 23 of the expandable metal sleeve 8 and abuts the expandable metal sleeve. The eutectic material 14 is in the first condition arranged upstream to the first opening 16, and in the second condition the eutectic material abuts the inner face 10 of the expandable metal sleeve 8 downstream to the second opening 17. In the intermediate position, the eutectic material 14 is flowing in the fluid communication channel 15 in order to move to the second axial channel position 22. The first axial channel position 21 is closer to the first axial position 51 than the second axial position 52. The fluid communication channel 15 may be a tube 18 as shown in FIG. 2A. The tube 18 is a metal tube, such as a hollow heat tube, e.g. of cobber, metallically connected with the tubular metal part 6, as shown in FIG. 3, so that the heating unit of the downhole tool string 50 is able to heat the tube and thus keep the eutectic material flowable. The first well tubular metal structure 3*a* has a higher melting point than that of the eutectic material 14 so that only the eutectic material changes to a flowable condition. The tube 18 may also be heated by other means, such as electric wires or thermite, even though not shown.

In the second axial position 52 and the second condition of the eutectic material 14, the eutectic material is, in FIG. 2B, positioned inside the annular space 11, but may also be positioned outside the expandable metal sleeve 8 sealing between the outer face 9 of the expandable metal sleeve and the inner face 4 of the borehole 5 or another well tubular metal structure 3 (shown in FIG. 6). Thus, in the second condition the eutectic material 14 may be arranged both inside and outside the expandable metal sleeve 8, which is suitable for plug and abandonment of the well or part of the well when sidetracking above the abandoned part. As the eutectic material 14 such as bismuth alloy is metallic, the eutectic material, in the second condition when positioned between the expandable metal sleeve 8 and the first well tubular metal structure 3*a*, provides a full metal-to-metal seal which is very strong. When the eutectic material 14 is positioned between the expandable metal sleeve 8 and the wall of the borehole 5, the sealing ability of the eutectic material is less efficient.

In the first condition shown in FIG. 2A, the eutectic material 14 has a first volume V1, and in the intermediate condition the eutectic material has a second volume being smaller than the first volume. The eutectic material 14 comprises bismuth or an alloy of bismuth, and the eutectic material is thus a post-transition metal material such as bismuth or a bismuth alloy in one monolithic whole as a block or in powder form.

In the first condition, the eutectic material 14 extends at least partly around a circumference of the tubular metal part 6, either in the form of separate elements, an open-ended, ring-shaped element or a full ring. In the second condition, the eutectic material 14 extends fully around the circumference of the tubular metal part 6, as the eutectic material flows in the intermediate condition and evenly self-distributes around the circumference of the tubular metal part 6 when positioned inside the annular space 11, or around the circumference of the expandable metal sleeve 8 when positioned outside the expandable metal sleeve.

As shown in FIG. 3, one of the ends of the expandable metal sleeve 8 is connected with the tubular metal part 6 by means of a connection part 41, 42, and in FIGS. 2A and 2B both the first end 31 and the second end 32 of the expandable metal sleeve 8 is connected to the tubular metal part 6 by means of a first connection part 41 and a second connection part 42. In FIG. 5, the fluid communication channel 15 extends through the connection part 41, 42, providing fluid communication to the annular space 11. In FIGS. 3 and 4, the fluid communication channel 15 is arranged to partly abut part of the outer face 9 of the expandable metal sleeve 8 so as to guide the eutectic material 14 in its flowable intermediate condition to the outside of the expandable metal sleeve on top of the sealing unit 27. Thus, in the second condition the eutectic material 14 overlaps the second axial extension 23. The second opening 17 is arranged to overlap the second axial extension 23 of the expandable metal sleeve 8.

As shown in FIG. 4, the annular barrier 1 further comprises a chamber 19 arranged on the outer face 7 of the tubular metal part 6, and in the first condition the eutectic material 14 is in powder form and arranged in the chamber. The chamber 19 has a chamber opening 20 in fluid communication with the first opening 16 of the fluid communication channel 15. The tube 18 forming the fluid communication channel 15 may also comprise powered eutectic material 14. In the first condition, the first opening 16 is abutting the eutectic material 14. In FIGS. 1, 2A, 3, 5 and 6, the eutectic material 14 is a solid block of eutectic material. In FIG. 5, the first opening 16 and the second opening 17 are both arranged in the first connection part 41, and the first opening 16 comprises a plug 28 which may at least partly be made of a eutectic compound or alloy so that the plug is removed when heated, e.g. by the heating unit 54 of the downhole tool string 50 (as shown in FIG. 1) or other means such as thermite or electric wire.

The annular barrier 1 may further comprise an equalising fluid channel 24 as shown in FIGS. 2A and 2B. The equalising fluid channel 24 provides fluid communication between the annular space 11 and the annulus 103 for allowing fluid within the annular space to flow out of the annular space when the eutectic material 14 is displacing the fluid. The equalising fluid channel 24 may be fluidly connected to a valve unit 25, shown in FIG. 1, so that the equalising fluid channel 24 is also used as a conduit 38 controlling fluid communication between the expansion opening and the annular space 11 via the conduit 38, as shown in FIG. 1. In another annular barrier 1, part of the conduit 38 is used as the fluid communication channel 15. In FIGS. 2A and 2B, the equalising fluid channel 24 has a first aperture 33 in fluid communication with the annular space 11 and a second aperture 34 in fluid communication with the second zone.

In order to provide a better seal when the expandable metal sleeve 8 is expanded to abut the inner face 4 of the borehole 5 or another well tubular metal structure, the expandable metal sleeve is provided with a plurality of sealing units 27 on the outer face 9 of the expandable metal sleeve 8, as shown in FIG. 1. The sealing units 27 are arranged in a circumferential groove 29 of the expandable metal sleeve 8. At the groove 29, the expandable metal sleeve 8 has a first thickness $t_1$, and between two grooves the expandable metal sleeve has a second thickness $t_2$ being greater than the first thickness. The sealing unit 27 further comprises an annular sealing element 35 and a retaining element 36. The retaining element 36 is a wound ring so that the retaining element is able to partly unwind as the expandable metal sleeve 8 is expanded, providing a proper back-up to the annular sealing element 35. In FIG. 6, an intermediate sealing element 37 is arranged between the annular sealing element 35 and the retaining element 36 so that the retaining element does not rupture the annular sealing element as it unwinds during expansion. In order to keep the annular sealing element 35 in the groove 29, the annular sealing element has different widths w1, w2, w3, where w2 is greater than w1, but smaller than w3. In one annular barrier 1, the retaining element 36 comprises a post-transition metal material such as bismuth or a bismuth alloy. The annular sealing element 35 is made of elastomer, natural or synthetic rubber, polymer or a similar material.

As shown in FIGS. 3-5, the eutectic material 14 has a first outer diameter O1 when being in the first condition, and the first outer diameter is smaller or equal to an outer diameter O2 of the expandable metal sleeve 8 in an unexpanded condition. In this way, the eutectic material 14 is not hindering insertion of the annular barrier 1 into the well. In the intermediate condition, the eutectic material 14 may be at least partly in a liquid state.

The first zone 101 may be a production zone, and the eutectic material 14 is arranged in the second zone 102 so that when the eutectic material enters the annular space 11 displacing fluid in the annular space, the lower pressure in the first zone will assist the fluid out of the annular space through the equalising fluid channel 24 due to the lower pressure in the production zone. In some wells, the pressure in the non-producing zone is lower than the pressure in the producing zone, and in such wells the eutectic material is in its first condition arranged in the second non-producing zone.

As shown in FIG. 7*a*, the equalising fluid channel 24 is arranged in the same end as the fluid communication channel 15 so that when the eutectic material 14 enters the annular space 11, it displaces fluid in the annular space 11 through the equalising fluid channel 24. As the annular space 11 is filled up with the eutectic material 14, the eutectic material 14 enters through the equalising fluid channel 24 and settles on top of the annular barrier 1 as shown in FIG. 7*b*. The annular barrier 1 further comprises the valve unit 25 controlling fluid communication between the expansion opening 12 and the annular space 11 via the conduit 38 during expansion of the expandable metal sleeve 8.

As shown in FIG. 1, a downhole system 100 is disclosed comprising the annular barrier 1 and the downhole tool string 50 comprising the heating unit 54 for heating the eutectic material 14.

In FIG. 8, the annular barrier 1 comprises the heating unit 54 for heating the eutectic material 14. The heating unit 54 is arranged on the outer face of the tubular metal part 6 next to the eutectic material 14. The annular barrier 1 further comprises insulation 43 arranged to enclose the heating unit 54 and the eutectic material 14.

FIG. 9 shows part of the downhole system 100 where the tool string 50 comprises both the heating unit 54 and a fluid displacement section 55. The fluid displacement section 55 has a first part 55*a* arranged on one side of the heating unit 54 and a second part on the other side of the heating unit 54 along the longitudinal extension of the tool string 50 so that the heating unit 54 is arranged opposite the eutectic material 14 arranged in a chamber 19, and the first and the second part 55*a*, 55*b* of the fluid displacement section 55 are arranged in order to displace fluid, i.e. prohibit fluid from passing through and cooling the heated zone. Thus, the fluid displacement section 55 has the function of blocking the well tubular metal structure 3*a* in the vicinity of the heating unit 54 so that fluid flowing in the well does not flow past the heated zone and cools the heated zone down before the heat is transferred to the eutectic material 14.

In FIG. 10, the annular barrier 1 comprises the heating unit 54 arranged on the outer face of the tubular metal part 6 next to the eutectic material 14, and the downhole tool string 50 comprises the fluid displacement section 55. Thus, an auxiliary tool section is run in the well tubular metal structure 3*a* to displace well fluid from the heated zone, thus mitigating any heat loss due to convection inside the well tubular metal structure 3*a*. So when the heating unit 54 is activated and heats the eutectic material 14, the fluid displacement section 55 at the same time hinders fluid inside the well tubular metal structure 3*a* from cooling the heated zone. The heating unit 54, the chamber with eutectic material 14 and the fluid communication channel 15 are encapsulated by insulation 43.

The heating unit 54 may comprise an activation unit having three positions. The first position is where the activation unit is in a safe state and in inactive mode, the second position is where the activation unit is in a safe state and in arming mode, and the third position is where the activation unit is in arming mode. The second position ensures that the activation unit is not unintentionally activated, but to set the activation unit into "arming mode" requires two movements, and not just an intentional bump during completion of the well. In the second position, the activation unit can be programmed to send a signal that the unit is functioning as intended before the unit is set into arming mode.

In FIGS. 11A and 11B, the annular barrier comprises only the eutectic material 14 in the first condition and the first axial position as shown in FIG. 11A and in the second condition and second axial position as shown in FIG. 11B forms a solidified plug outside and abuts the outer face of the expandable metal sleeve. In another embodiment, the annular barrier comprises only bentonite material 14B in a chamber 19B, which is released as described in relation to FIGS. 12A and 12B to form a solidified plug outside and abutting the outer face of the expandable metal sleeve.

The annular barrier may comprise both a eutectic material 14 and a bentonite material 14B as shown in FIGS. 12A and 12B. The bentonite material 14B is arranged in the chamber 19B, and the eutectic material 14 is arranged in the chamber 19, and both chambers are arranged on the outer face of the tubular metal part. The bentonite material 14B may in the first condition be in form of powder and arranged inside the chamber 19B and then released into the annulus to react with well fluid and form an annular plug on top of and abutting the expandable metal sleeve 8 as shown in FIG. 12B. The eutectic material 14 is heated and then flows into the annular space 11 via the fluid communication channel 15 in order to move to the second axial channel position 22. By having bentonite material 14B arranged on the outer face 7 of the tubular metal part 6, the sealing ability of the annular barrier 1 can easily be re-established just by letting the bentonite material 14B into the well fluid. Furthermore, by having eutectic material the annular space 11 can be filled with the eutectic material displacing the fluid inside the annular space and form a proper plug as the eutectic material solidifies. The bentonite material can then be used outside the annular barrier and the eutectic material inside the annular barrier. But in another embodiment, it may be vice versa. The flowable bentonite material 14B and flowable eutectic material 14 are thus able to enter smaller gaps than when the eutectic material is in its solid state, and upon solidification the eutectic material and the bentonite material increase in volume and fill up the gap even better. Thus, an annular barrier having such eutectic material and bentonite material is suitable for implementation into a salt formation as the annular barrier is then still able to provide a proper seal even after some time when the salt formation has enlarged.

In FIG. 13, the annular barrier 1 comprises the heating unit 54 for heating the eutectic material 14. The heating unit 54 comprises a chamber with thermite material 26, a liquid 30 and a heater 39 in form of a heating channel 40 extending into the chamber 19 with eutectic material 14. The thermite when ignited heats the liquid which then flows in the heating channel 40 of the heater 39 and heats the eutectic material 14 which then flows into the annular space of the annular barrier 1 via a channel in an end of the expandable metal sleeve 8. The heating is arranged on the outer face of the tubular metal part 6 to heat the eutectic material 14 where a pump 44 may be arranged to assist circulation of the heated liquid inside the heating channel 40. The annular barrier 1 further comprises insulation 43 arranged to enclose the heating unit 54 and the eutectic material 14.

The annular barrier of FIG. 14A comprises only a bentonite material 14B which in a first condition is arranged on the outer face of the tubular metal part in a first axial position 51 different from and not overlapping the second axial extension of the expandable metal sleeve, and in a second condition and a second axial position 52 the bentonite material abuts a face 9, 10 of the expandable metal sleeve, as shown in FIG. 14B. The bentonite material has an intermediate condition where it is positioned between the first axial position and the second axial position. In the first condition and first axial position 51, the bentonite material 14B is in powder form in the chamber 19B and when in the intermediate condition, the bentonite material is released into the well fluid and undergoes a reaction with the well fluid and swells into the second condition in the form of a clay positioned on top of the expanded expandable metal sleeve and forms a firm plug in the second axial position 52. Subsequently, cement may be positioned on top of the bentonite plug before abandoning the well or that well part. The bentonite material 14B is arranged in the chamber 19B on one side of a piston 45 diving the chamber into a first chamber part comprising the bentonite material 14B in the first condition, and a second chamber part having some kind of pressure charge 48, such as thermite, gas cartridge or similar which when activated generates sufficient power to break a shear pin 47 maintaining the piston in a first piston position shown in FIG. 14A and move the piston to a second piston position shown in 14B by shearing a shea disc 46 and displacing the bentonite material out of the chamber 19B and into the annulus to react with the well fluid and solidify into a plug.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "annular barrier" is meant an annular barrier comprising a tubular metal part mounted as part of the well tubular metal structure and an expandable metal sleeve surrounding and connected to the tubular metal part defining an annular barrier space.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. An annular barrier for expansion in an annulus between a first well tubular metal structure and an inner face of a borehole or a second well tubular metal structure for providing zone isolation between a first zone and a second zone of the annulus, the annular barrier having a first axial extension, where the annular barrier comprises:

a tubular metal part for mounting as part of the first well tubular metal structure, the tubular metal part having an outer face, an expandable metal sleeve surrounding the tubular metal part and having an outer face facing towards the inner face of the borehole or the second well tubular metal structure and an inner face facing the outer face of the tubular metal part, a second axial extension along the first axial extension, and each end of the expandable metal sleeve being connected with the tubular metal part, an annular space between the expandable metal sleeve and the tubular metal part, an expansion opening in the tubular metal part through which fluid may enter the annular space in order to expand the expandable metal sleeve, a eutectic material and/or a bentonite material which in a first condition is arranged on the outer face of the tubular metal part in a first axial position different from the second axial extension of the expandable metal sleeve, and in a second condition and a second axial position the eutectic material and/or the bentonite material abuts a face of the expandable metal sleeve, and in an intermediate condition the eutectic material and/or the bentonite material is positioned between the first axial position and the second axial position, and a fluid communication channel extending from a position facing the outer face of the tubular metal part and having a first opening in a first axial channel position, and the fluid communication channel extending towards a second opening in a second axial channel position, where the second axial channel position overlaps or abuts an axial position of the expandable metal sleeve, and in the first condition the eutectic material is arranged upstream to the first opening, and in the second condition the eutectic material abuts the face of the expandable metal sleeve downstream to the second opening.

2. An annular barrier according to claim 1, wherein one of the ends of the expandable metal sleeve is connected with the tubular metal part by means of a connection part, and the fluid communication channel extends through the connection part, providing fluid communication to the annular space.

3. An annular barrier according to claim 2, wherein the first opening and the second opening are arranged in the connection part.

4. An annular barrier according to claim 1, wherein in the second condition the eutectic material and/or the bentonite material overlaps the second axial extension.

5. An annular barrier according to claim 1, wherein the fluid communication channel is arranged to partly abut part of the outer face of the expandable metal sleeve.

6. An annular barrier according to claim 1, further comprising a chamber arranged on the outer face of the tubular metal part; in the first condition, the eutectic material and/or the bentonite material is in powder form arranged in the chamber.

7. An annular barrier according to claim 1, wherein the eutectic material is a solid block of eutectic material.

8. An annular barrier according to claim 7, further comprising a chamber having a chamber opening in fluid communication with the first opening of the fluid communication channel.

9. An annular barrier according to claim 1, wherein in the second condition the eutectic material and/or the bentonite material is arranged at least partly on the outer face of the expandable metal sleeve.

10. An annular barrier according to claim 1, wherein in the second condition the eutectic material and/or the bentonite material is arranged at least partly in the annular space.

11. An annular barrier according to claim 1, further comprising an equalising fluid channel providing fluid communication between the annular space and the annulus for allowing fluid within the annular space to flow out of the annular space when the eutectic material and/or the bentonite material is displacing the fluid.

12. An annular barrier according to claim 1, wherein the first opening, in the first condition, is abutting the eutectic material.

13. An annular barrier according to claim 1, wherein in the first condition the eutectic material and/or the bentonite material extends at least partly around a circumference of the tubular metal part.

14. A downhole system comprising the annular barrier according to claim 1 and a downhole tool string comprising a heating unit for heating the eutectic material.

15. A downhole system comprising the annular barrier according to claim 1 wherein in an intermediate condition the eutectic material and/or the bentonite material is positioned inside the fluid communication channel.

* * * * *